United States Patent [19]

Baker

[11] 4,304,164

[45] Dec. 8, 1981

[54] VIOLIN, KIT AND METHOD OF MAKING SAME

[76] Inventor: Charles P. Baker, 6905 Moyer Pl., McLean, Va. 22101

[21] Appl. No.: 85,203

[22] Filed: Oct. 16, 1979

[51] Int. Cl.[3] ..... G10D 1/02

[52] U.S. Cl. ..... 84/277; 84/274; 84/309

[58] Field of Search ..... 84/173, 274–283, 84/291–292, 299–302, 309–311, 314

[56] References Cited

U.S. PATENT DOCUMENTS

| | | | |
|---|---|---|---|
| 235,382 | 12/1880 | Rohlfs | 84/300 |
| 939,486 | 11/1909 | Fish | 84/314 R |
| 1,123,946 | 1/1915 | Steuer | 84/277 |
| 1,133,782 | 3/1915 | Anderson | 84/291 |
| 1,668,832 | 5/1928 | Swanson | 84/291 |
| 1,786,891 | 12/1930 | Brown et al. | 84/275 |
| 4,126,072 | 11/1978 | Taylor | 84/173 |

*Primary Examiner*—Lawrence R. Franklin

*Attorney, Agent, or Firm*—Roylance, Abrams, Berdo & Farley

[57] ABSTRACT

A method of making a violin including forming the body, neck, sound post and backplate as a unitary structure from a single piece of material such as wood. The fingerboard, shim and nut is also formed as a single piece. The top plate, bridge, tailpiece and peg structure are separately provided and assembled with the body-neck and fingerboard members in a simple and inexpensive instrument. A kit with components thus formed is disclosed.

6 Claims, 12 Drawing Figures

VIOLIN, KIT AND METHOD OF MAKING SAME

This invention relates to a method of producing a viol or violin and more particularly, to a method of making violin components which can be supplied as a kit which can easily be assembled into a finished instrument by one inexperieced in instrument manufacture, and to the instrument itself.

BACKGROUND OF THE INVENTION

The manufacture of bowed string instruments has a long and colorful history including the work of many skilled craftsman. Through trial and error, and more recently through the application of principles of acoustics, ways of making instruments such as the violin have developed and changed, but the basic techniques normally used have not been altered fundamentally since the work of artisans in the early 18th century.

The traditional technique, much simplified, involves cutting a top or front plate, preferably from spruce wood, cutting a back plate from curly maple, pear or sycamore wood, cutting side strips from curly maple, constructing a form, bending the side strips and gluing them, on the form, to corner blocks, cutting the neck from maple, the fingerboard and tailpiece from ebony and the bridge from maple, and shaping and joining these parts, with the soundpost, bass bar, pegs, etc. in a complex procedure which requires much time, skill and care. The result, if properly done, can be an instrument of fine quality and excellent sound.

The procedure is, quite obviously, highly labor intensive and the resulting instrument, even if done on a more "mass production" basis, is necessarily rather expensive. Thus, one who is a beginning player, or one who wishes to play as a rather casual hobby, must make a substantial investment to obtain an instrument of even moderate quality.

The traditional, and some more recently developed, techniques of violin and other instrument construction are described in the following documents which are mentioned for general informational purposes.

"Violins and Violinists" by Franz Farga, publ. by Barrie & Rockliff, The Cresset Press, London (1969).

"Making Musical Instruments", by Irving Sloane, A Sunrise Book, E. P. Dutton, New York (1978).

"Makin' Your Own Country Instruments", by Andy dePaulle, Oliver Press, Willits, California (1976).

*Violin-Making As American Art*, Philip Kass and Michael Olmert, Smithsonian Magazine, Vol. 8, No. 6, September, 1977, pp. 107–110.

"The Physics of Music" Readings from Scientific American, publ. by W. H. Freeman & Co., San Francisco, (1978); articles by C. M. Hutchins, "The Physics of Violins" (pp. 56–68) from November, 1962 issue; and by John C. Schelleng, "The Physics of the Bowed String" from January, 1974 issue.

Various efforts at producing violins, mostly of unusual structure, are shown in the following U.S. Pat. Nos.: 244,730 Berliner, 752,080 Lambotte, 759,850 Battram, 769,649 Grover, 934,413 Moertel, 1,329,594 Going, 1,384,492 Sivard, 1,438,386 Lucas, 1,447,174 Grover, 1,555,813 Allison, 1,556,871 Nichols, 1,786,891 Brown et al.

In addition, there are kits available from certain manufacturers, such as the International Violin Co., 414 E. Baltimore Street, Baltimore, Maryland 21202, and Scherl and Roth, Inc., 1729 Superior Avenue, Cleveland, Ohio 44114. The kit approach is, at least in theory, a highly desirable one because it permits one who has time but relatively little money to invest his or her effort and obtain a usable instrument. Unfortunately, the kits which are available rely on traditional construction approaches and it is necessary for the purchaser to have considerable manual skill in the assembly process, even when starting with the partly prefabricated components, in order to have an instrument with good sound as the end product.

BRIEF SUMMARY OF THE INVENTION

Accordingly, it is an object of the present invention to provide a method of making the components for a violin in such a way that the components can be easily assembled into a good quality instrument by someone having little skill and no previous experience in violin construction.

A further object is to provide the components for a violin, which components are simple and inexpensive to produce.

A further object is to provide a violin having a minimum number of structural components and which is relatively durable, inexpensive and produces good quality sound.

Yet another object is to provide components for a violin which can be produced by an inexperienced person but which has reproducably good sound, from one instrument and person to another.

Briefly described, the invention includes a method of making a violin comprising the steps of forming a violin body, neck, back plate and sound post as an integral, unitary structure, the body having walls and an opening in the end thereof opposite the neck end, and the neck having side and front openings therein near the distal end thereof to receive tuning pegs an strings, respectively; forming a top plate and bass bar as a separate assembly, adhering the top plate to the walls of the body, separately forming a unitary fingerboard, nut and shim structure, adhering the fingerboard and shim structure to the neck, providing a bridge, adhering the bridge to the top plate, providing a tailpiece having a generally U-shaped hook at one end dimensioned to be received in the opening at the end of the body and four hook elements at the other end, attaching tuning pegs to the openings provided therefor in the neck; and connecting violin strings between the tailpiece hook elements and the tuning pegs.

In another aspect the invention includes a violin comprising an integral, unitary body, backplate, sound post and neck structure, said body having side walls perpendicular to said backplate and defining an interior chamber, and said sound post extending perpendicularly from said backplate through said chamber; a substantially planar top plate having inner and outer major surfaces and a bass bar adhered to said inner surface, said inner major surface abutting the distal end of said sound post and being adhered to said side walls at the margins thereof; a bridge adhered to the outer major surface of said top plate; an integral, unitary fingerboard, nut and shim structure adhered to said neck; a tailpiece coupled to said body and having hook means for retaining one end of each of a plurality of strings; and tuning peg means attached near the distal end of said neck for retaining the other ends of said strings.

The invention also includes a kit for making a violin comprising an integral, unitary body, backplate, sound post and neck structure, said body having side walls perpendicular to said backplate and defining an interior chamber and said sound post extending perpendicularly from said backplate and spaced from said side walls such that the distal edges of said side walls and the distal end of said sound post lie in the same plane; a substantially planar top plate having inner and outer major surfaces and having a bass bar adhered to the inner surface thereof; a bridge; an integral, unitary fingerboard, nut and shim structure; a tailpiece having hook means for engaging one end of each of a plurality of strings; and tuning peg means attachable near the distal end of said neck for engaging the other ends of said strings.

In order that the manner in which the foregoing and other objects are attained in accordance with the invention can be understood in detail, particularly advantageous embodiments thereof will be described with reference to the accompanying drawings, which forms a part of this specification, and wherein.

Figure 1:
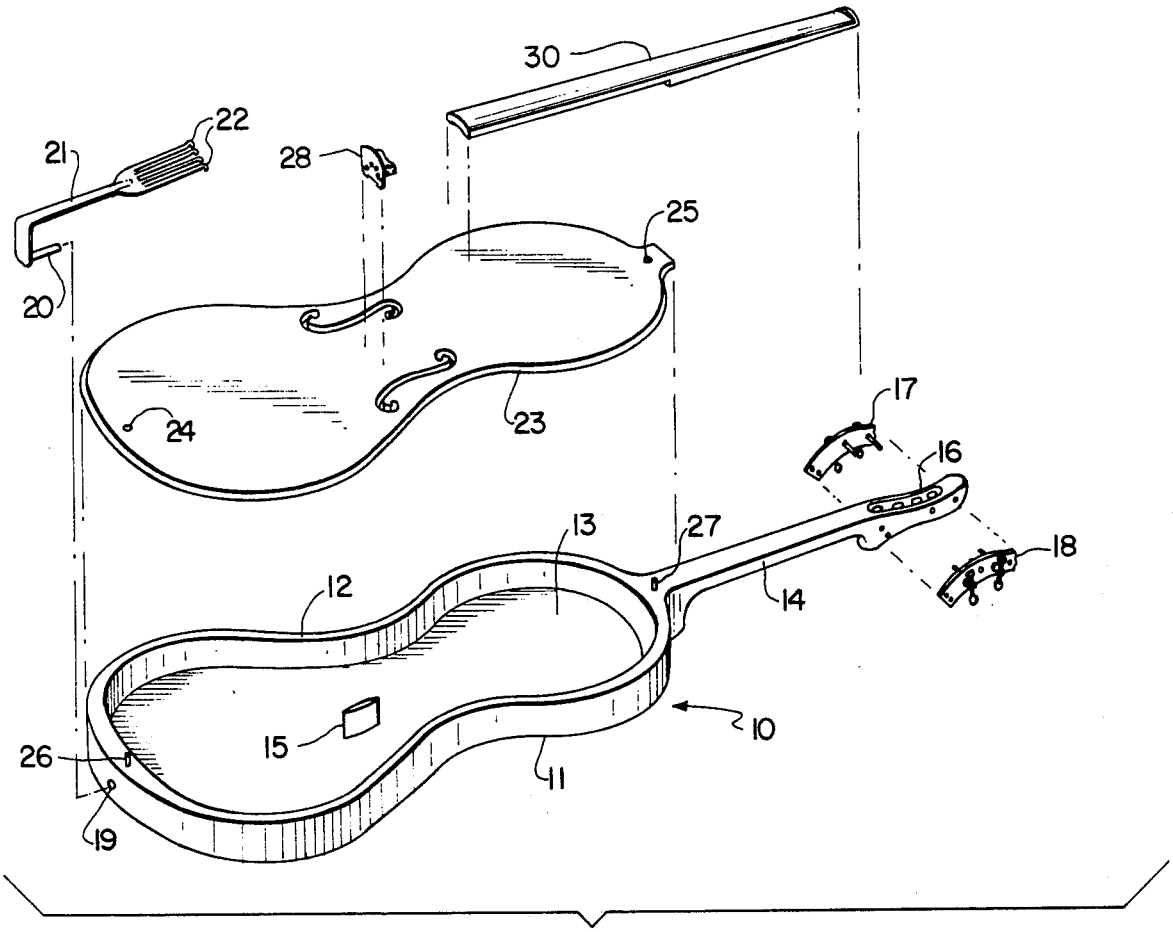
FIG. 1 is an exploded perspective view of the components of a violin in accordance with the present invention.

Turning now to the drawings in detail, it will be seen that FIG. 1 shows an exploded view of the various components of a violin kit produced in accordance with the invention. The terminology used to describe these components is generally consistent with standard terminology applied to the instrument, although there are some differences because of certain novel structural aspects of the kit of the present invention. As shown in FIG. 1, the violin includes a body and neck structure indicated generally at 10 and including a body 11 having a continuous, generally hour-glass shaped wall 12, a backplate 13, a neck 14, and a sound post 15. The distal end of the neck is shaped to form a peg box 16 to which tuning peg assemblies 17 18 are attached.

At the other end of the body, farthest from the neck, a hole 19, having an axis parallel with the longitudinal axis of the body, is provided to receive an end 20 of a tailpiece 21, the tailpiece having hooks 22 to engage and retain one end of each of the four strings to be supplied to the instrument.

A top plate 23 is shaped to conform to the outer configuration of wall 12 of body 11 and is provided with holes 24 and 25 to engage alignment pegs 26 and 27 extending upwardly from the upper edges of wall 12. A bridge 28 is to be adhered to the upper surface of top plate 23, and a fingerboard, nut and shim structure 30 is adhered to the upwardly facing surface of neck 14.

Following assembly, conventional violin strings (not shown) are connected between the hooks 22 on the tailpiece and the tuning pegs, the strings extending over the bridge and nut and above and spaced from the fingerboard.

Figure 2:
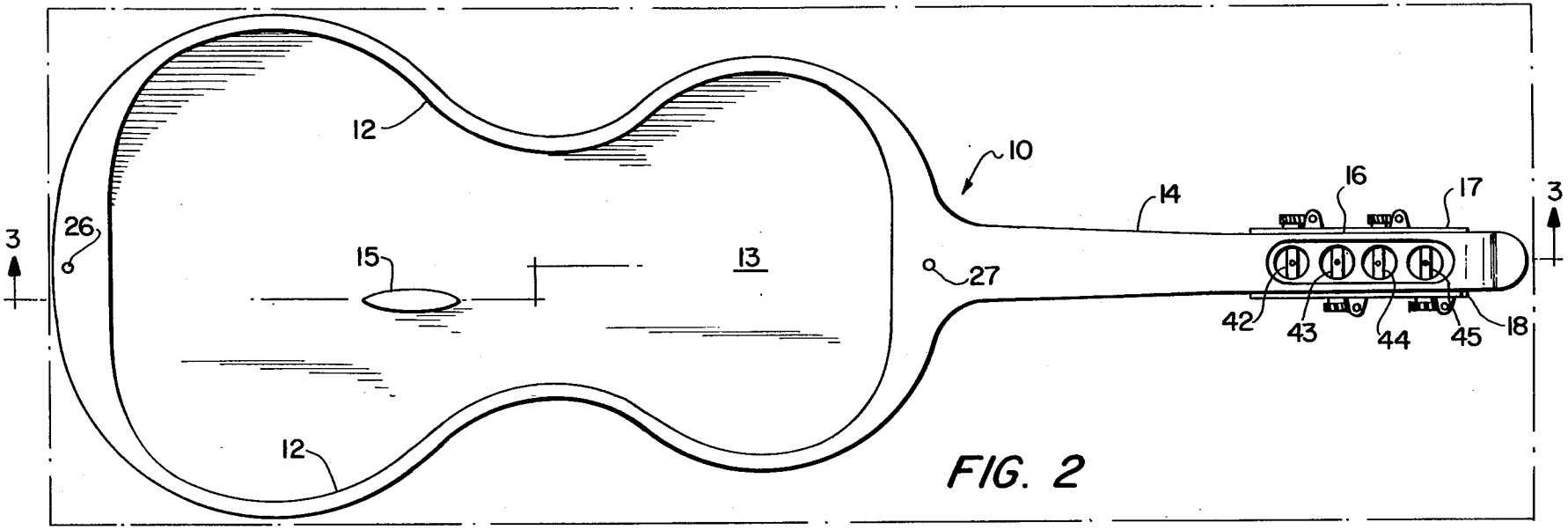
FIG. 2 is a top plan view of the unitary main body and neck of the violin of FIG. 1.
Figure 3:
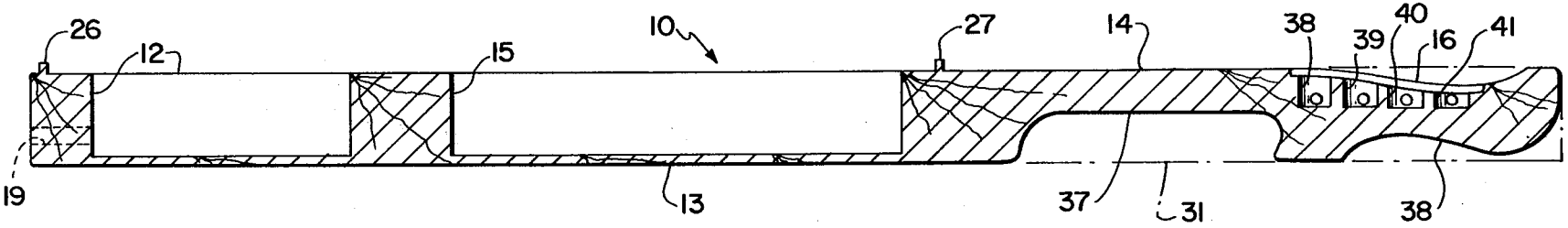
FIG. 3 is a side elevation, in section, along line 3—3 of FIG. 2.

As best seen in FIGS. 2 and 3, the entire structure 10, including the body with wall 12, back plate 13, sound post 15, neck 14 and peg box 16 are formed from a single piece of wood, the outline of a typical piece of wood from which this structure can be formed being indicated at 31. This is particularly significant because it permits the simple and inexpensive formation of the integral, unitary body, neck, backplate and sound post which contributes to the extremely simple assembly of the instrument and the resulting good sound characteristics thereof. In forming the body in this fashion, a generally rectangular piece of wood 31 is provided with the grain of the wood extending generally parallel with the long axis of the rectangular block. The plan view outline of the instrument, as seen in FIG. 2, is then cut from this piece of wood, using a conventional tool such as a band saw.

It will be recognized from FIGS. 2 and 3 that the dimensions of the starting block should be such that the width and length are at least as great as the desired width and length of the final instrument, and that the thickness thereof should be at least equal to the desired final thickness of the instrument, not including the alignment pegs 26 and 27, although those could also be integrally formed with the instrument. It is simpler, however, to form pegs 26 and 27 separately and insert them later in the assembly process.

The cavity within walls 12 is then formed by hollowing out the interior of the instrument with a conventional woodworking tool such as a router, taking care to leave sound post 15 protruding into the hollow volume from the backplate, and also taking care to form the recess such that backplate 13 remains.

It will be observed that sound post 15 is somewhat different in configuration and placement from that of a conventional violin. As is customary, sound post 15 is located so as to be directly beneath that portion of the top plate on which one leg of the bridge 28 will rest. However, it is normal for the sound post to be a generally cylindrical dowel, and for it to be inserted and retained by friction after assembly of the structure including the walls, backplate and top plate. However, by forming it integrally with the backplate, there are several advantages. First, the delicate placement of the sound post, and the critical location thereof within the body is avoided. Normally, the sound post is not adhered in place, and the placement through the f-holes in the top plate is a difficult process requiring considerable skill. In the present structure, the sound post is fixedly located and solidly coupled to the backplate, being an integral portion thereof, and, since it is also the same height as walls 12, it comes in contact with, and is preferably glued to, the top plate of the violin in the desired fashion.

It will be observed that the outer configuration of the instrument shown in FIGS. 1 and 2 differs from that of the conventional violin in that it does not have the compound curve configuration nor the purfling normally found in a violin. In standard violin construction procedures, this compound curve relationship has structural significance because of the traditional manner of forming the side strips or ribs and gluing them to corner and end blocks. The instrument formed in accordance with the present invention can, if desired, be formed with this compound curve design, the outer configuration being a matter of choice. However, it is not necessary for any structural reason and the simpler form is therefore shown in the drawings. Omission of the compound curves also has the advantage of permitting manufacture by handicapped individuals who could not cope with cutting the more complex shape. The compound curve is shown in dotted lines in the bottom plan view of the top plate, of FIG. 4.

Figure 4:
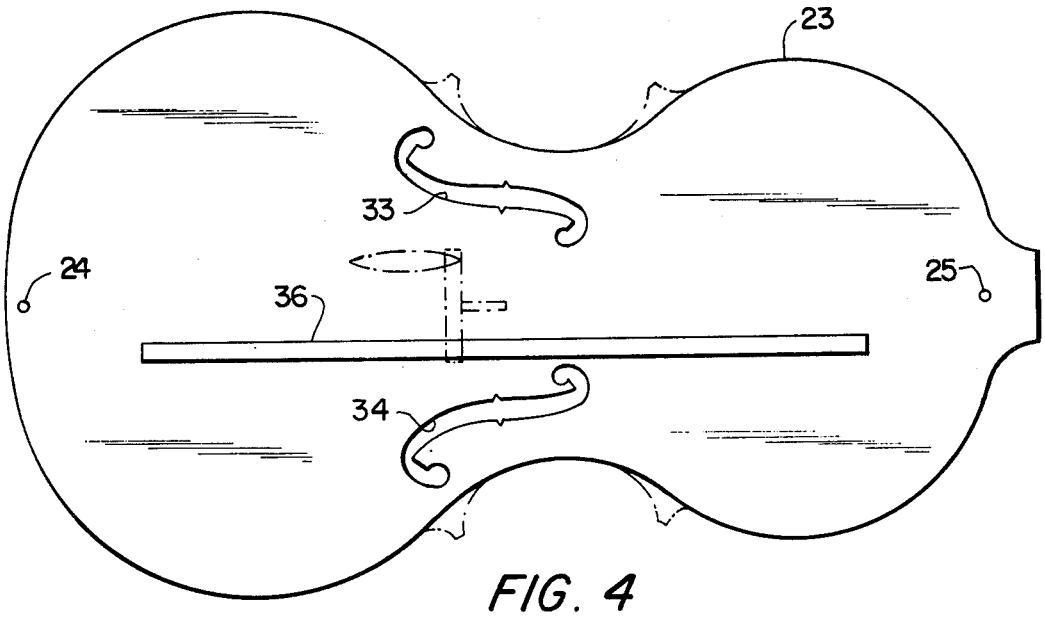
FIG. 4 is a bottom plan view of the cover or top portion of the violin of FIG. 1.

As seen in FIG. 4, the top plate 23 is a planar member, the outer configuration of which is cut to match the outer shape of body 12, and the conventional f-holes 33 and 34 are cut therein. A base bar 36 is adhered to the inner surface of the top plate along a line generally parallel with the center longitudinal line of the top plate, but offset therefrom so as to lie under the other leg of the bridge on the side opposite that supported by sound post 15, this being in accordance with conventional violin construction techniques. The location of the area where the sound post will contact the inner surface of top plate 23, as well as the bridge location in the assembled structure, is indicated in FIG. 4 by dash-dot lines.

As seen in FIG. 3, the back portion of the neck is reduced in thickness to form a reduced portion 37, and the end thereof is shaped as at 38 to form the back of the peg box. This shaping of portion 37 is also in conformance with conventional violin construction techniques and forms a region about which the hand can be comfortably placed, the peg box shape being somewhat optional and intended primarily for attractiveness of appearance.

The upper surface of the peg box is provided with openings 38–41 which extend inwardly from the front surface to permit entry of the strings. Tuning peg plate assemblies 17 and 18 are attached to the side of the peg box by screws, these assemblies having tuning pegs 42–45 with openings to receive the ends of the strings. The tuning mechanisms include worm and spur gear drives, the worms being connected to tuning handles in a manner well known in connection with such instruments as guitars. Alternatively, conventional tapered pegs can be used, but the tapered pegs require more careful and skillful fitting and the gear assemblies are therefore preferred when the instrument is being assembled by a relatively unskilled person. Alternate ones of openings 38–41 also are provided with lateral openings to permit insertion of the pegs therethrough, and the opposite sides have recesses to support the distal ends of the pegs.

Figure 5:
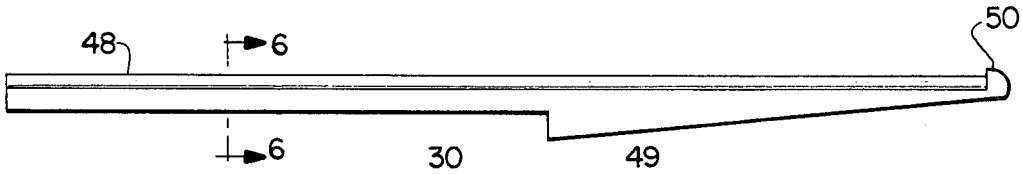
FIG. 5 is a side elevation of the unitary fingerboard, shim and nut of the violin of FIG. 1.
Figure 6:
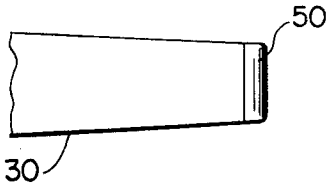
FIG. 6 is a partial top plan view of the nut end of the fingerboard structure of FIG. 5.
Figure 7:
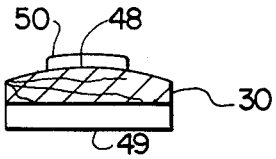
FIG. 7 is an end view, in transverse section, along line 6—6 of FIG. 5.

The fingerboard, shim and nut structure is shown in FIGS. 5, 6 and 7, and includes a fingerboard portion having an upper curved surface 48, a shim portion 49 with a lower, flat surface intended to be adhered to the neck between the peg box and the end of top plate 23, and a nut 50. As seen in FIG. 6, the fingerboard tapers in plan view to conform generally to the lateral taper of the neck, nut 50 being an upstanding end portion over which the strings pass, the height of the nut above the fingerboard surface being provided to keep the strings spaced from the fingerboard surface 48 until they are pressed against that surface by the fingers of the player.

Figure 8:
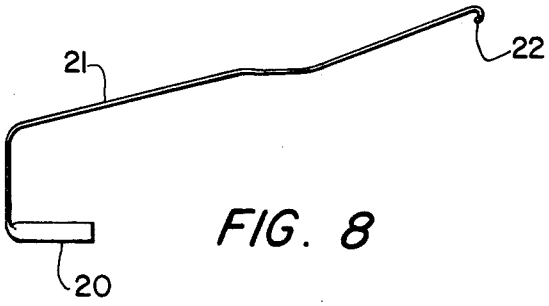
FIG. 8 is a side elevation of the tailpiece of the violin of FIG. 1.
Figure 9:
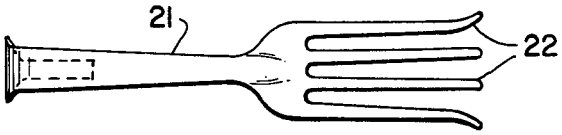
FIG. 9 is a top plan view of the tailpiece of FIG. 8.

The tailpiece is shown in FIGS. 8 and 9 and constitutes a unique structure in that it is formed from a single piece which is similar in shape and nature to a table fork and, in the embodiment shown, is actually made from a conventional stainless steel table fork. The handle end of the fork is bent twice to form a J-shape, the distal end of the J being bent over itself to form a generally tubular member which constitutes end portion 20 and is insertable into opening 19. The ends of the tines of the fork are bent backward to form hooks 22 to engage loops at the ends of the strings. As will be recognized, conventional strings are used in connection with this instrument, and such strings are normally provided with looped ends which can engage hooks 22. Since the tailpiece is unitary, no separate end button is provided or necessary.

Figure 10:
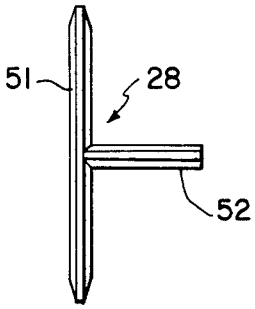
FIG. 10 is a top plan view of the bridge of the violin of FIG. 1.
Figure 11:
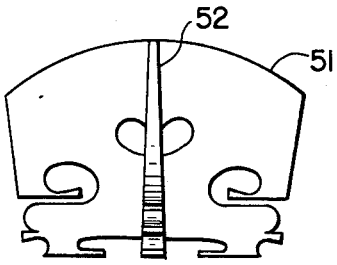
FIG. 11 is a front elevation of the bridge of FIG. 10.

The bridge in accordance with the present invention is shown in FIGS. 10 and 11. As will be recognized, the bridge is unique in that it has a transverse portion 51 and a longitudinally extending portion 52, portion 52 constituting one-half of a conventional bridge, and portion 51 constituting a conventional bridge adhered to portion 52, thereby forming a T-shaped bridge having three legs. This is a particularly advantageous arrangement because, with three legs, the location and placement thereof, and the adhering of the legs and feet thereof to the surface of top plate 23, is greatly simplified. It is well known in violin construction that the configuration of the bridge is significant because it commonly performs a filtering action which removes certain undesirable high frequencies in the process of conducting vibrations from the strings to the top plate. Thus, the configuration of portion 51 of the bridge as seen in FIG. 11 remains unchanged from that of a conventional violin, and the addition of portion 52 contributes to the ease in construction without deleterious effect to this desirable filtering action.

Figure 12:
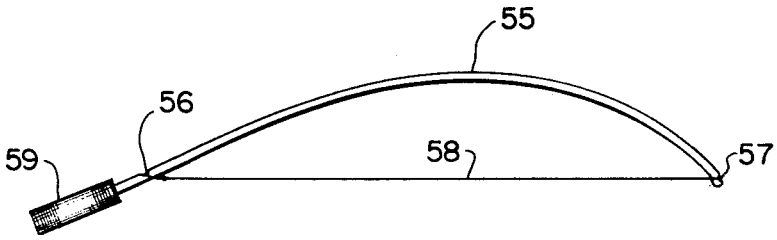
FIG. 12 is a side elevation of a bow usable with the instrument of FIGS. 1–11.

A simple bow which can be provided for use with this instrument is shown in FIG. 12, the bow constituting a bent elongated wooden member 55 which has been notched at 56 and 57 to receive a length of string, such as nylon monofilament 58, provided with loops at both ends to engage the notches. A handle 59 which can be formed from any cylindrical body of light weight, is placed on, and glued to, the end of the wooden member 55.

As will be seen, the construction and assembly of the violin as disclosed herein is extremely simple. The unitary, integral body and neck structure is approximately 24.5 inches (62.23 cm.) and the width of the body at the widest place is approximately 8.5 inches (21.6 cm.), the width of the body at the smaller wide portion being approximately 6.75 inches (17.15 cm.). The neck tapers from approximately 1.25 inches (3.18 cm.) to 1 inch (2.54 cm.). The thickness of the body, in the dimension shown in FIG. 3, is approximately 1.44 inches (3.65 cm.), the depth of the recess being approximately 1.25 inches (3.18 cm.), leaving the backplate 13 with a thickness of approximately 0.1875 inches (4.75 mm). The sound post is approximately 0.375 inches wide (0.95 cm.) and about 1.625 inches (4.13 cm.) in length. Its height from the backplate is, of course, the same as the depth of the recess.

The top plate is approximately 15 inches long and the bass bar is adhered to the under surface thereof with the center line of the bass bar being laterally spaced from the center line of the top plate by approximately 0.5 inches (1.27 cm.). The bass bar is formed in a conventional manner, being substantially square at its longitudinal centerpoint, about 10 inches (25.4 cm) long and about 0.3125 inches (0.79 cm.) on a side. It is tapered, in profile, toward both ends.

In assembling the instrument from the components described, the body, top plate, fingerboard structure and bridge are sanded and finished, as desired, and the bridge assembly is then adhered to the proper location on the top surface of the top plate. When provided as a kit, this location is marked on the outer face, but can readily be determined by placing the top plate on but slightly spaced on one side from the body and observing the location of one end of the sound post, looking in between the top plate and wall 12. The top plate is then adhered to the top edges of wall 12, and to the top of sound post, clamping during the gluing process to be sure of a firm joint. The fingerboard is then glued to the neck, the end of the fingerboard closest to the bridge being aligned therewith. No other gluing is necessary. When the glue has set, the tuning peg assemblies 17 and 18 are fastened to the sides of peg box 16 and tailpiece 21 is attached with member 20 in hole 19. The strings are then placed on hooks 22 and inserted in the peg holes and tightened to the desired tension, tuning the strings in accordance with conventional violin standards.

As previously indicated, the bow shown in FIG. 12 can be used, or, alternatively, a conventional bow can be acquired and used with the instrument.

While one advantageous embodiment has been chosen to illustrate the invention, it will be understood by those skilled in the art that various changes and modifications can be made therein without departing from the scope of the invention as defined in the appended claims.

What is claimed is:

1. A violin comprising:

an integral, unitary body, backplate, sound post and neck structure, said body having side walls perpendicular to said backplate and defining an interior chamber, and said sound post comprises a pillar having a generally elliptical cross section, the long dimension of the ellipse being along a line generally parallel with the longitudinal centerline of the body and neck, said sound post extending perpendicularly from said backplate through said chamber;

a substantially planar top plate having inner and outer major surfaces and a bass bar adhered to said inner surface;

said inner major surface abutting the distal end of said sound post and being adhered to said side walls at the margins thereof;

a bridge adhered to the outer major surface of said top plate;

an integral, unitary fingerboard, nut and shim structure adhered to said neck;

a tailpiece coupled to said body and having hook means for retaining one end of each of a plurality of strings; and tuning peg means attached near the distal end of said neck for retaining the other ends of said strings.

2. A violin according to claim 1 wherein the length-to-width ratio of the pillar is at least 4:1.

3. A violin according to claim 1 wherein the depth of said interior chamber is about 8 times the thickness of said backplate.

4. A kit for making a violin comprising:

an integral, unitary body, backplate, sound post and neck structure, said body having side walls perpendicular to said backplate and defining an interior chamber and said sound post comprises a piller having a generally elliptical cross section, the long dimension of the ellipse being along a line generally parallel with the longitudinal centerline of the body and neck, said sound post extending perpendicularly from said backplate and spaced from said side walls such that the distal edges of said side walls and the distal end of said sound post lie in the same plane;

a substantially planar top plate having inner and outer major surfaces and having a bass bar adhered to the inner surface thereof;

a bridge;

an integral, unitary fingerboard, nut and shim structure;

a tailpiece having hook means for engaging one end of each of a plurality of strings; and tuning peg means attachable near the distal end of said neck for engaging the other ends of said strings.

5. A violin according to claim 4 wherein the length-to-width ratio of the pillar is at least 4:1.

6. A violin according to claim 4 wherein the depth of said interior chamber is about 8 times the thickness of said backplate.

* * * * *